US011680375B2

(12) United States Patent
Breault et al.

(10) Patent No.: US 11,680,375 B2
(45) Date of Patent: Jun. 20, 2023

(54) ROAD SURFACING MACHINE

(71) Applicant: Paradox Access Solutions Inc., Acheson (CA)

(72) Inventors: Marc Breault, Acheson (CA); Wilfred J. Cupido, Edmonton (CA)

(73) Assignee: Paradox Access Solutions Inc., Acheson (CA)

( * ) Notice: Subject to any disclaimer, the term of this patent is extended or adjusted under 35 U.S.C. 154(b) by 709 days.

(21) Appl. No.: 16/727,765

(22) Filed: Dec. 26, 2019

(65) Prior Publication Data

US 2021/0189661 A1 Jun. 24, 2021

(30) Foreign Application Priority Data

Dec. 24, 2019 (CA) ..... 3066150

(51) Int. Cl.
*E01C 7/04* (2006.01)
*E01C 19/20* (2006.01)
*E01C 19/52* (2006.01)

(52) U.S. Cl.
CPC ..... *E01C 7/04* (2013.01); *E01C 19/2035* (2013.01); *E01C 19/522* (2013.01); *E01C 2019/209* (2013.01)

(58) Field of Classification Search
CPC ..... E01C 7/04; E01C 19/2035; E01C 19/522; E01C 2019/209
See application file for complete search history.

(56) References Cited

U.S. PATENT DOCUMENTS 1,946,819 A * 2/1934 Stevenson ..... E01C 23/03 404/108
2,384,395 A * 9/1945 Payne ..... E01C 19/522 180/9
3,261,270 A * 7/1966 Wilson ..... E01C 23/04 404/72
3,814,144 A * 6/1974 Spencer ..... E04G 21/12 404/100
4,742,970 A * 5/1988 Barazone ..... E01C 23/03 242/615
4,806,043 A * 2/1989 Fournier ..... E02F 5/104 210/170.07
7,316,521 B2 * 1/2008 Shiomoto ..... E04B 1/665 156/577
8,079,778 B2 * 12/2011 Colkitt ..... E01C 23/04 404/100
8,375,643 B1 * 2/2013 Harrop ..... B09B 1/004 405/129.9

(Continued)

*Primary Examiner* — Abigail A Risic
(74) *Attorney, Agent, or Firm* — Seed Intellectual Property Law Group LLP

(57) ABSTRACT

An automated system for creating a road from sand, gravel or aggregate in conjunction with expandable webbing is provided in which expandable webbing and sand, gravel or aggregate may be positioned and deployed by the system to form a road surface. A series of pins may restrain and transport the webbing. An automatic welder may connect sections of webbing. A hopper, conveyor and auger may receive and distribute the sand, gravel or aggregate. The sand, gravel and aggregate may be combined with the expandable webbing and then settled into place in the ground using a vibration plate.

24 Claims, 9 Drawing Sheets

(56) References Cited

U.S. PATENT DOCUMENTS

| | | | | |
|---|---|---|---|---|
| 8,888,403 | B2 * | 11/2014 | Atherton | E01C 19/4866 404/110 |
| 10,378,161 | B2 * | 8/2019 | Whitaker | E02D 17/202 |
| 10,538,884 | B2 * | 1/2020 | Harco | E01C 23/04 |
| 11,174,599 | B2 * | 11/2021 | Kim | E01C 19/30 |
| 2003/0016999 | A1 * | 1/2003 | Jones, IV | E01C 11/165 404/111 |
| 2009/0274516 | A1 * | 11/2009 | Colkitt | E01C 23/04 404/100 |
| 2010/0268372 | A1 * | 10/2010 | Zurbuchen | B29C 66/43 700/122 |
| 2017/0268182 | A1 * | 9/2017 | Wigley | E01C 19/522 |
| 2018/0155880 | A1 * | 6/2018 | Cawthern | E01C 11/165 |
| 2018/0258594 | A1 * | 9/2018 | Harco | E01C 7/16 |

* cited by examiner

ROAD SURFACING MACHINE

BACKGROUND

Technical Field

Surface building using webbing and aggregate materials, particularly road building.

Description of the Related Art

Current methods for deploying and filling webbing for road materials and road maintenance generally use manual labor. Using such a system may have various drawbacks, including being costly, creating erosion, and causing construction materials to be deposited outside of the desired area.

BRIEF SUMMARY

There is proposed a system for creating roads where expandable webbing is stretched out and filled with sand, gravel or aggregate to reduce the required costs of road materials and road maintenance. This may reduce the effects of erosion and contain the construction materials to the correct area. The proposed system will automate the process of joining the sections of webbing and depositing raw material into the pockets of the webbing. Benefits of the proposed system may include increasing the speed at which road surface can be laid down while also greatly reducing the manual labor required.

In an embodiment, there is a road surfacing system including a mobile frame. A webbing conveyor is mounted on the frame. The webbing conveyor extends between a webbing receiving end and a webbing distributing end. A filler distributor is mounted on the frame adjacent to the webbing distributing end of the webbing conveyor.

In various embodiments of the system, there may be included one or more of the following features: a webbing connector mounted on the frame and adjacent to the webbing receiving end of the webbing conveyor; the webbing connector is an automatic welder; the webbing conveyor further comprises a webbing expander between the webbing receiving end and the webbing distributing end; the webbing expander further comprises a plurality of pins extending between guides; the webbing conveyor further comprises a plurality of conveyors between the webbing receiving end and the webbing distributing end; the filler distributor further comprises a hopper and an auger; a crane mounted on the mobile frame; a geocloth dispenser mounted on the frame adjacent to the webbing distributing end of the webbing conveyor; a control station mounted on the frame, the control station operatively connected to the webbing conveyor and the filler distributor; a vibration plate mounted on the frame adjacent to the webbing distributing end of the webbing conveyor; the automatic welder further comprises a plurality of welding elements and a first linear actuator operatively connected to the plurality of welding elements, the first linear actuator causing each of the plurality of welding elements to move between an open position and a closed position; the automatic welder further comprises a second linear actuator operatively connected to the plurality of welding elements, the second linear actuator causing the plurality of welding elements to move between a raised position and a lowered position; and the automatic welder having a guard plate.

In yet another embodiment, there is a method of surfacing a road. Webbing is placed onto a webbing conveyor mounted on a mobile frame. The webbing conveyor extends between a webbing receiving end and a webbing distributing end. The mobile frame is moved across the ground while webbing is distributed from a webbing distributing end of the webbing conveyor. Filler is distributed with the webbing from a filler distributor mounted on the frame adjacent to the webbing distributing end of the webbing conveyor.

In various embodiments of the method, there may be included one or more of the following features: the webbing including sections of webbing and the method further including connecting adjacent sections of webbing using a webbing connector mounted on the frame adjacent to the webbing receiving end of the webbing conveyor; the webbing connector is an automatic welder; the webbing includes sections of expandable webbing and in which the method includes expanding the sections of webbing using a webbing expander between the webbing receiving end and the webbing distributing end of the webbing conveyor; the webbing expander further includes a plurality of pins extending between guides; the webbing conveyor further includes a plurality of conveyors between the webbing receiving end and the webbing distributing end; the filler distributor further includes a hopper and an auger; dispensing geocloth using a geocloth dispenser mounted on the frame adjacent to the webbing distributing end of the webbing conveyor; a control station is mounted on the frame, the control station operatively connected to the webbing conveyor and the filler distributor; and vibrating the filler with the webbing as it is placed on the ground using a vibration plate mounted on the frame adjacent to the webbing distributing end of the webbing conveyor.

BRIEF DESCRIPTION OF THE SEVERAL VIEWS OF THE DRAWINGS

Embodiments will now be described with reference to the figures, in which like reference characters denote like elements, by way of example, and in which.

DETAILED DESCRIPTION

Figure 1:
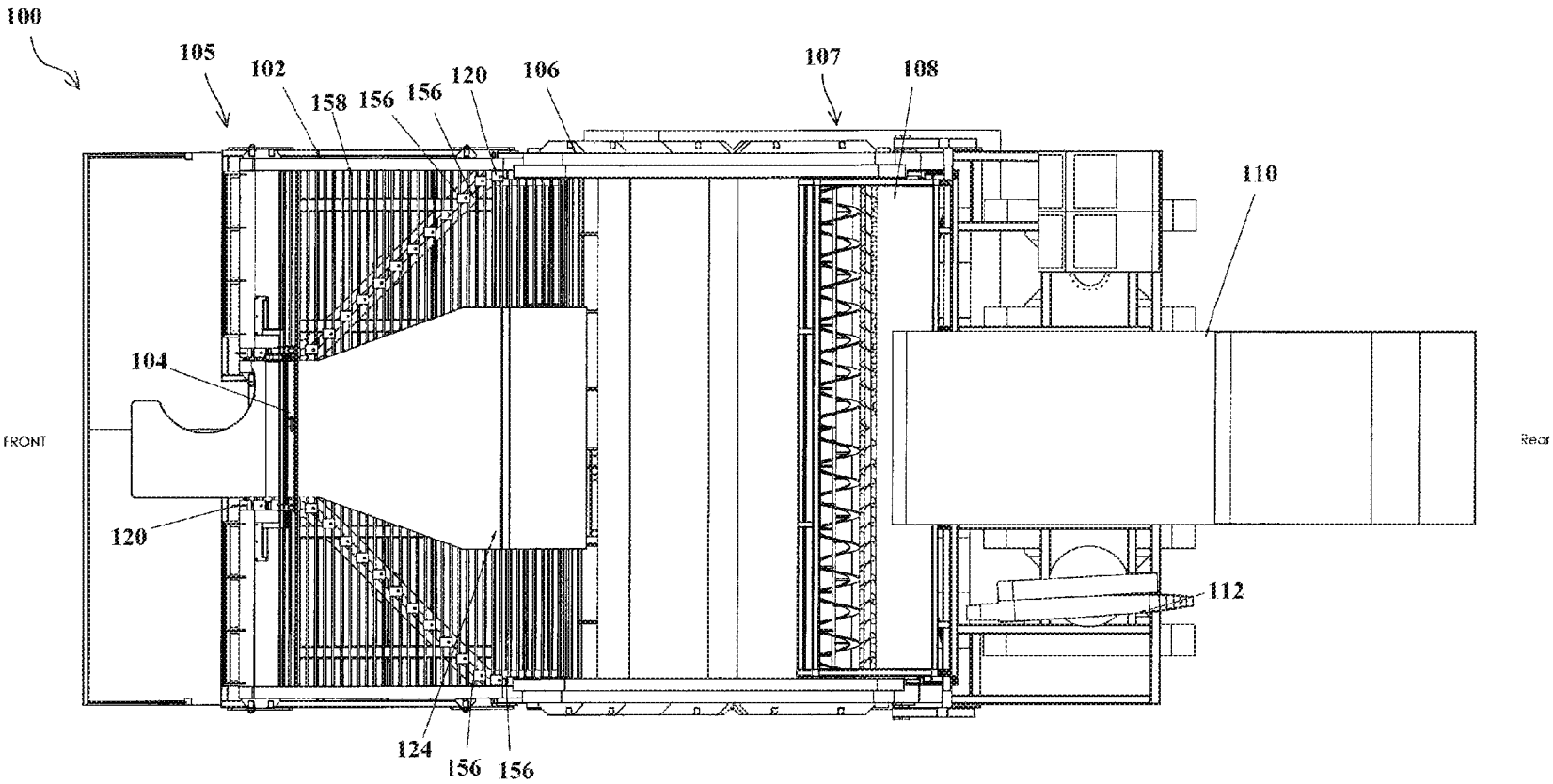
FIG. 1 is a top view of an embodiment of a road surfacing system.

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

Referring to FIGS. 1 to 4, there is an embodiment of a road surfacing system 100 mounted on a mobile frame 103. An expanding conveyor 102 and a picker conveyor 106 together form a webbing conveyor. The expanding conveyor 102 and picker conveyor 106 are both mounted on the frame 103. The webbing conveyor 102, 106 extends between a webbing receiving end 105 and a webbing distributing end 107. A filler distributor 108 is mounted on the frame 103 adjacent to the webbing distributing end 107 of the webbing conveyor.

A webbing connector 104 for connecting sections of webbing is mounted on the frame adjacent to the webbing receiving end 105 of the webbing conveyor. Preferably, as shown in the embodiment in FIG. 1, the webbing connector 104 is an automatic welder. Other methods of joining the sections of webbing may be used other than welding, such as by being connected by ties. As shown in FIG. 1, the expanding conveyor 102 includes a webbing expander 120, 156 between the webbing receiving end 105 and the webbing distributing end 107. In the embodiment shown in FIG. 1, the webbing expander is a plurality of pins 120 extending between guides 156. A cover 124 may be used to protect moving parts.

Figure 4:
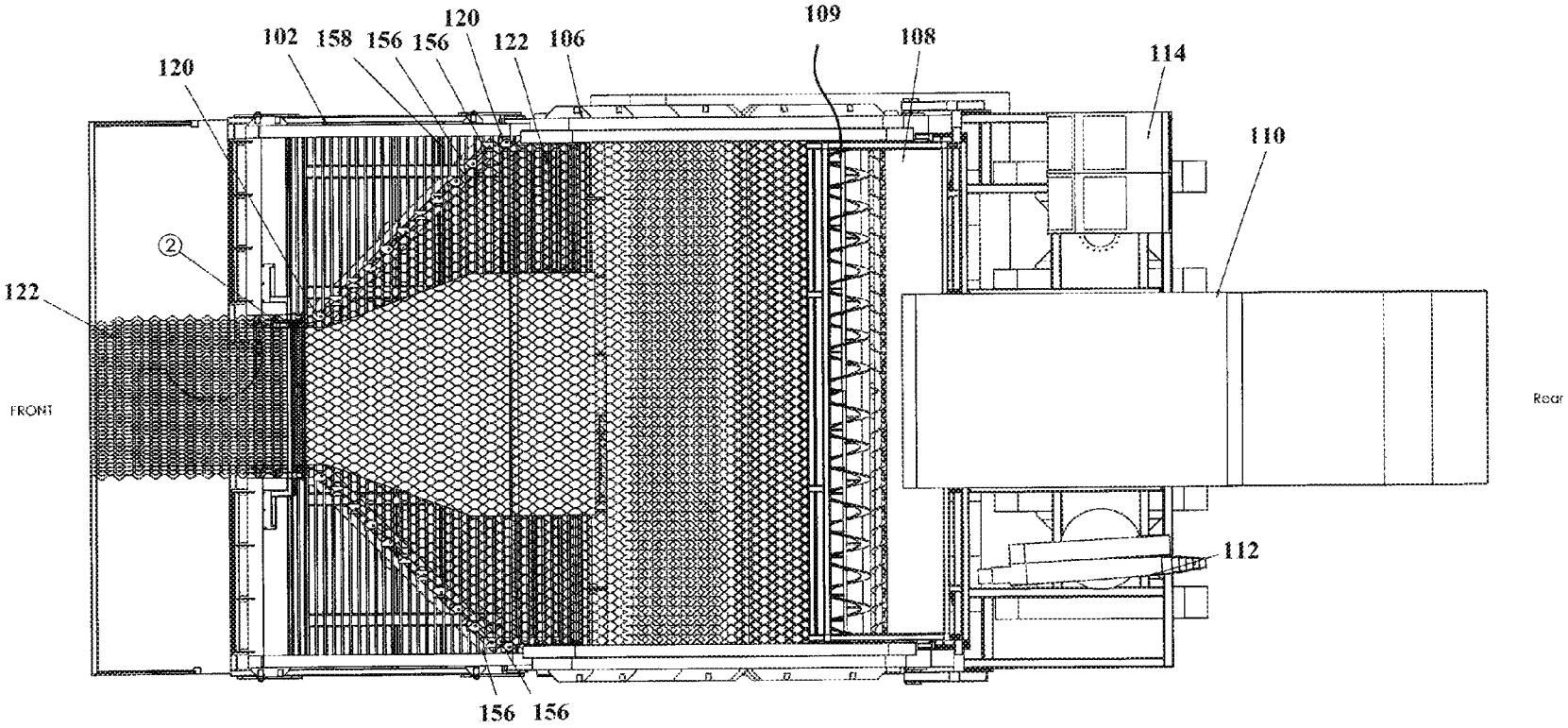
FIG. 4 is a top view of the road surfacing system of FIG. 1 showing webbing on the webbing conveyor.

The filler distributor 108 includes a hopper 111 (FIG. 5) and an auger 109 (FIG. 4). A crane 112 is mounted on the rear end of the mobile frame 103. A geocloth dispenser 116 is mounted on the frame adjacent to the webbing distributing end 107 of the webbing conveyor. A control station 114 is mounted on the frame 103. The control station 114 operatively connects to the webbing conveyor 102, 106 and the filler distributor 108.

Figure 5:
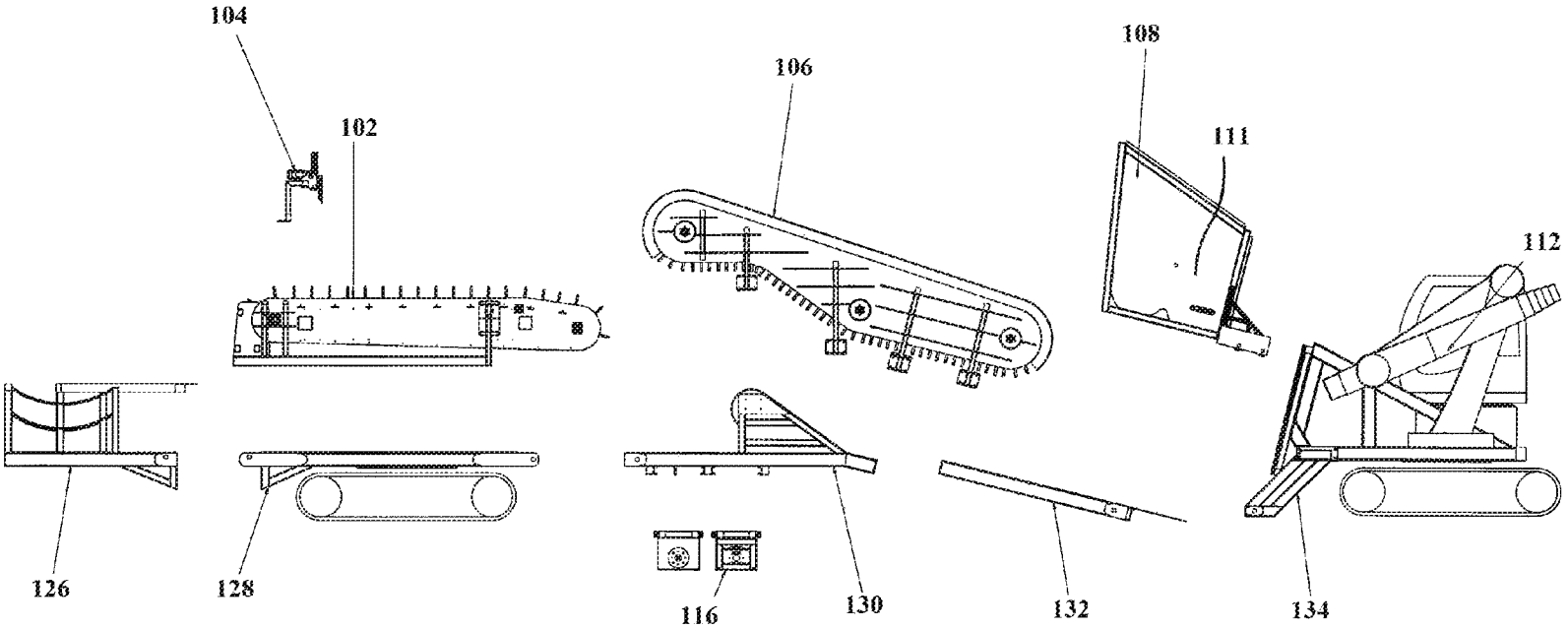
FIG. 5 is an assembly side view of the road surfacing system of FIG. 1.

A vibration plate is mounted on the frame 103 adjacent to the webbing distributing end 107 of the webbing conveyor. For example, the vibration plate may be integral with the base of the filler distributor 108 as shown in FIG. 5.

Figure 6:
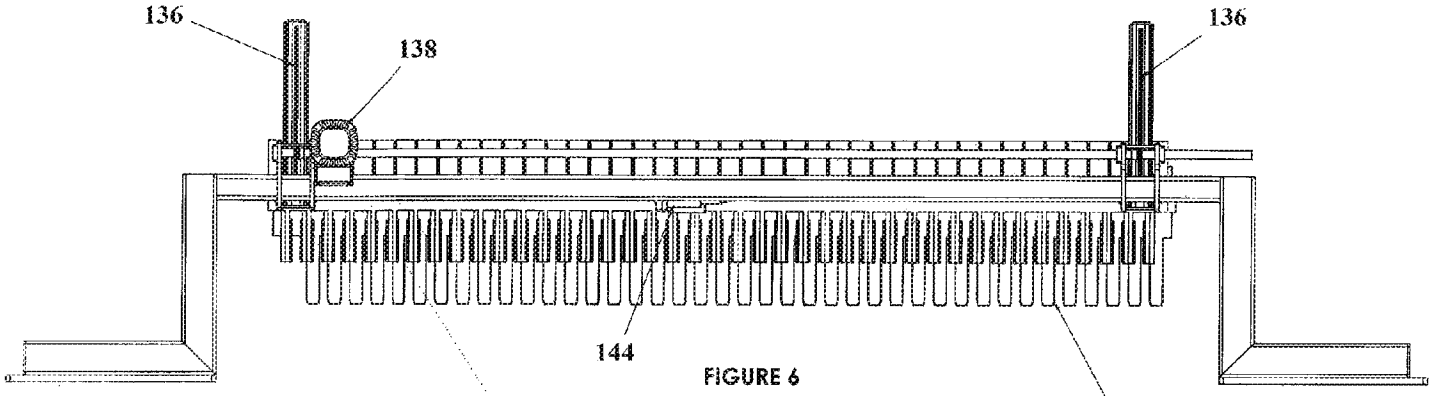
FIG. 6 is a front view of an embodiment of a welding system for use with a road surfacing system in an upper, non-welding position.
Figure 7:
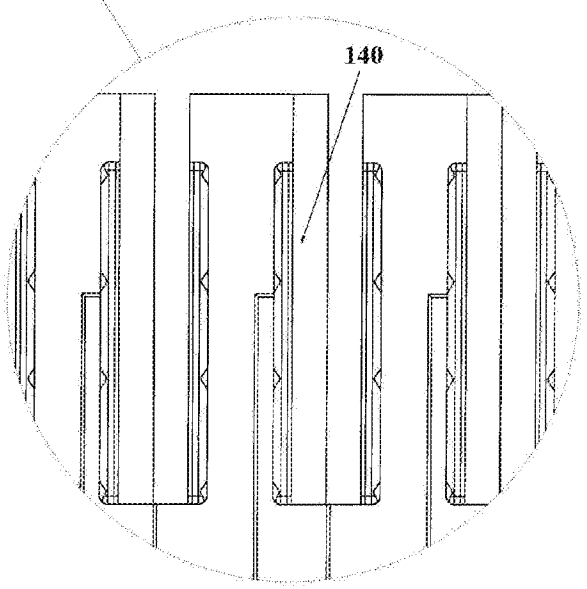
FIG. 7 is a detail view of the welding system of FIG. 6 in the upper or, non-welding position showing gaps between welding elements.
Figure 8:
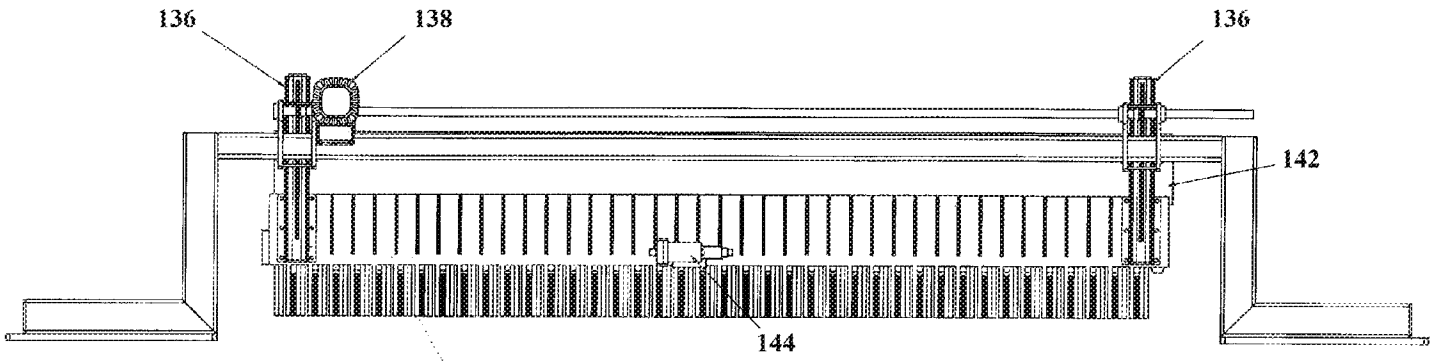
FIG. 8 is a front view of the welding system of FIG. 6 in the lower, welding position.
Figure 9:
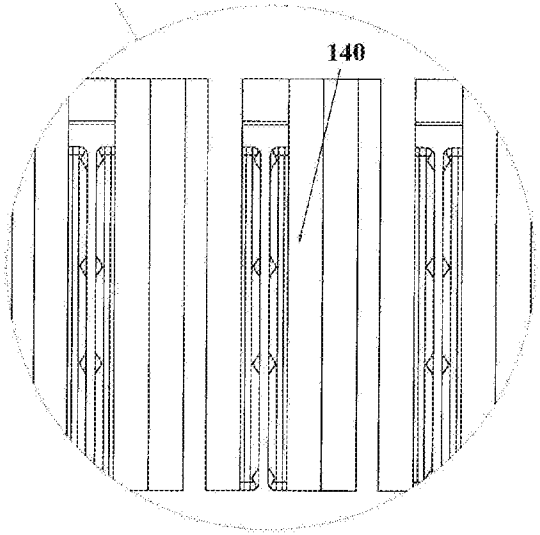
FIG. 9 is a detail view of the welding system of FIG. 8 in the lower, welding position showing the much smaller gap between welding elements.

As shown in FIGS. 6 to 9, the automatic welder 104 includes a plurality of welding elements 140 and a first linear actuator 144 operatively connected to the plurality of welding elements 140. The first linear actuator 144 may be a small electric drive which causes each of the plurality of welding elements to move between an open, non-welding position as shown in FIG. 7, and a closed, welding position as shown in FIG. 9.

The automatic welder 104 includes a second linear actuator 138 operatively connected to the plurality of welding elements 140. The second linear actuator 138 may be an electric drive which causes the plurality of welding elements 140 to move between an upper, non-welding position as shown in FIG. 6 and a lower, welding position as shown in FIG. 8. A guard plate 142 may protect the plurality of welding elements when in the upper position.

The road surfacing system can be operated by placing webbing onto a webbing conveyor mounted on the mobile frame 103. The mobile frame may then be moved across the ground while the webbing is distributed from the webbing distributing end of the webbing conveyor. Filler is distributed with the webbing from the filler distributor 108. Adjacent sections of webbing may be connected using the webbing connector 104.

The sections of webbing may be expanded during operation using the webbing expander 120, 156. Geocloth may be dispensed using the geocloth dispenser 116. The filler may be vibrated with the webbing as it is placed on the ground using the vibration plate.

The road surface system described herein creates a stable road surface using expandable webbing and sand, gravel, or aggregate. The mobile frame 103 of the road surfacing system may be formed from a number of separable frames that are sized and shaped to allow for transportation. A system of conveyors secure, expand, and transport the webbing through the system. The weld station or automatic welder 104 can join two sections of webbing, when given a signal or when the webbing is placed in position for welding. The filler distributor 108 may include a conveyor and at least one augur to receive and distribute the sand, gravel, or aggregate that is supplied. The vibration plate may cause the sand, gravel, or aggregate to settle fully. The crane 112 may facilitate the assembly of the system on site as well as moving raw product as needed. The mobile frame 103 may include a track system to support and direct the machine along its path. The mobile frame may also be mounted on wheels or supported on a separate system such as the bed of a truck so long as its weight can be supported and it is moveable.

The control station 114 allows for manual or automatic control and monitoring of the various systems within the road surface system. Preferably, the conveyor system may include the expanding conveyor 102 with pins projecting upwards which will pull the expandable webbing 122 out to the maximum width. The conveyor system will also preferably include the picker conveyor 106 after the expanding conveyor 102 with a set of conveyors where the pins are directed downwards to direct the expandable webbing towards ground level. Preferably also, the web will continue to be held by pins as the sand, gravel, or aggregate is deposited and distributed evenly. Preferably, the pins will continue to hold the expandable webbing in place while the vibration plate causes the raw material to settle into the pockets after which the pins will disengage and allow the completed product to be deposited on the ground allowing the trailing end of the system to ride along the new surface.

Preferably, the frame joint points will be flexible to allow transitions across variable terrain. In a preferred embodiment of the system, the height of deposited material will be regulated by moving the material receptacle and distribution system along a linear path to maintain its clearance above webbing of various heights.

The system for creating a stable road surface, according to a preferred embodiment, is capable of disassembly and transport along highways before being reassembled at the site. The system for creating a stable road surface should adhere to transportation guidelines when being transported. Preferably, as illustrated in FIG. 5, the system may be separated into sections, each of which will fit within the lane width of a standard road. The assembled length would not be allowed to travel on standard roads.

According to yet another aspect of the present disclosure, the road surface building device can be largely automated utilizing a programmable logic controller (PLC). The PLC allows the machine to operate on its own, requiring only a directional input along with the addition of more expandable webbing at the front of the machine and sand, gravel, or aggregate at the rear of the assembly.

The system for creating a stable road surface, according to a preferred embodiment, comprises a series of separable frames to facilitate transport including the conveyor section 102, 106, the automatic welder 104, the filler distribution system 108, and the vibration plate. Preferably, there is a section or controller room where the system operating and monitoring is carried out. The conveyor section comprises the set of conveyors 102 with pins directed upwards to locate and expand the expandable webbing that is input, followed by the set of conveyors 106 with pins directed downwards to take the webbing and direct it to ground level where it is deposited on a layer of geocloth. The automatic welding system is located above the first set of conveyors. For welder operation, the system may pause at set intervals to allow the new section of webbing to be welded onto the current sections.

Figure 2:
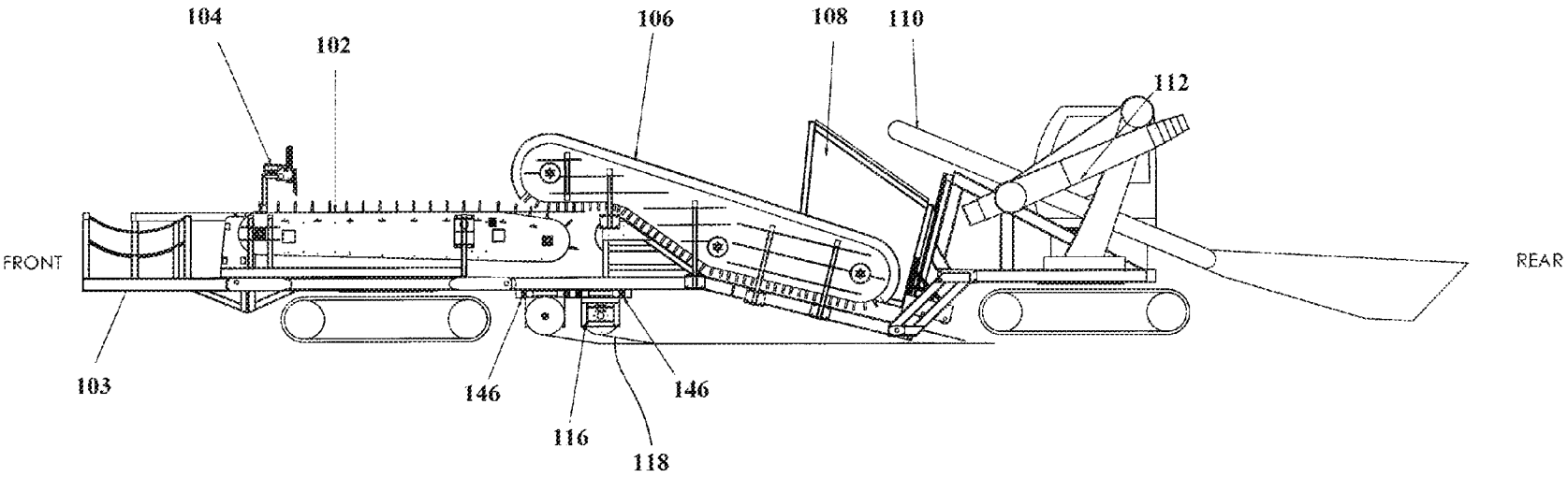
FIG. 2 is a side view of the road surfacing system of FIG. 1.
Figure 3:
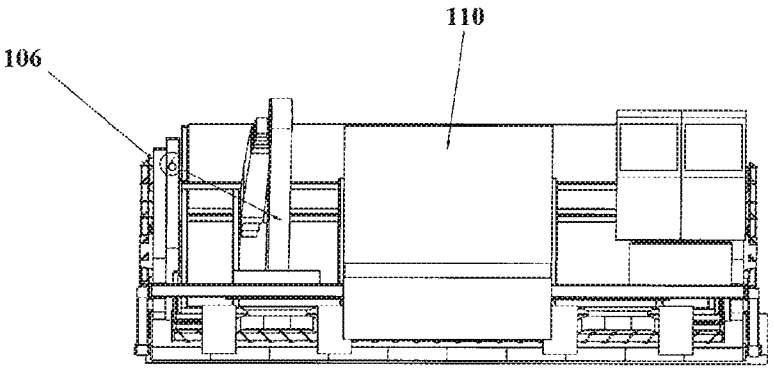
FIG. 3 is a rear view of the road surfacing system of FIG. 1.

As shown in FIGS. 1 and 2, the system is arranged with the expanding conveyor 102 first while the automatic welder 104 is then positioned directly above the expanding conveyor 106. Following this is the picker conveyor 106 which leads to the filler distributor 108 which is supplied by the hopper 111 and conveyor 110. To each side of the hopper and conveyor 110 are the crane 112 and the control station 114.

In FIG. 2, the geocloth mount 116 can be seen supporting a geocloth underlay 118.

As best seen in FIGS. 1 and 4, the spreading conveyor pins 120 hold the webbing 122 in position beneath the automatic welder 104 before drawing the webbing 122 out to its final extension using the carriage guides 156 within the expanding conveyor 102. Rods 158 allow the pins 120 to translate horizontally as they contact the guides 156. The web is then transferred to the picker conveyor 106 which moves it beneath the filler distributor 108 where the filler material is deposited and leveled.

The picker conveyor 106 then disengages from the web and allows it to progress onto the ground.

Preferably the automatic welder 104 is automated utilizing a programmable logic controller (PLC). When given the signal to begin a weld, each step will be timed and controlled from the control station 114. The welder 104 will lower, compress the web 122, and hold for a set time to ensure a complete weld has been achieved and allowed to cool. FIGS. 6 to 9 show a preferred embodiment of the welder portion in operation as the web is fed into position for welding. To allow the web passage, the welder moves vertically along linear tracks 136 propelled by the electric drive 138. When at the top of the linear track 136 the welding elements 140 are protected by the guard 142. Once the web is in place the electric drive 138 moves the welding elements 140 clear of the guide and into the web. Once the welding elements have reached the correct elevation a second, smaller electric drive 144 moves the welding elements together.

The automatic welder shown in FIGS. 6 to 9 uses a heated press/pin system to adhere the plastic joints of webbing together. An electrical system source may be used as supplied by the motor. Feeding into the automatic welder may be done manually by having a worker stand on the platform at the front of the road surfacing system. The worker may manually insert the ears into the welder.

FIGS. 6 and 8 illustrate the vertical travel of the plurality of welding elements 140 while FIGS. 7 and 9 show the horizontal movement of the plurality of welding elements 140. FIG. 5 shows a preferred system breakdown for travel. When assembling at a new site the forward chassis 128 is brought in first followed by the rear chassis 134. Following this the expanding conveyors 102 are put in place by the crane 112 after which they are fixed to the forward chassis 128, the welder 104 is then brought in and fixed to the top of the spreading conveyors, the different frame components 126, 130, and 132 (FIG. 5) of the mobile frame 103 are then set in place by the crane 112 where they are pinned together to maintain flexibility between sections. The geocloth mounts 116 are attached to their frame 130 after which the picker conveyors 106 and sand distributor 108 are put in place by the crane 112 where they are then connected to the frame. Preferably, the two chassis sections 128, 134 are set in place using radio control while the crane is operated from the control station 114.

Figure 13:
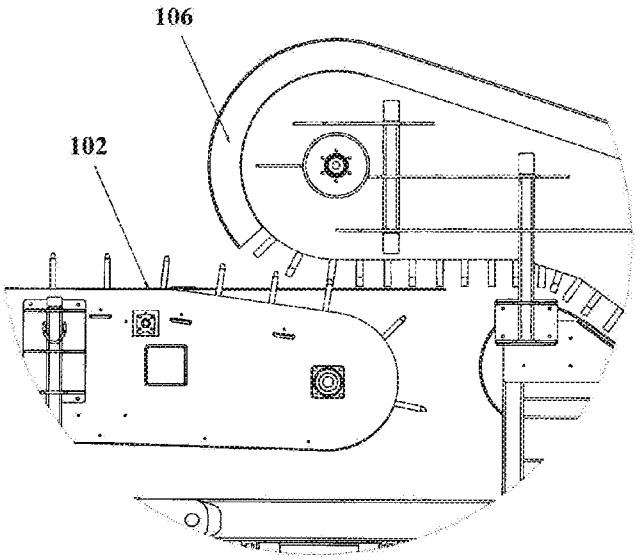
FIG. 13 is a side view of the interface between multiple conveyors in a road surfacing system.
Figure 12:
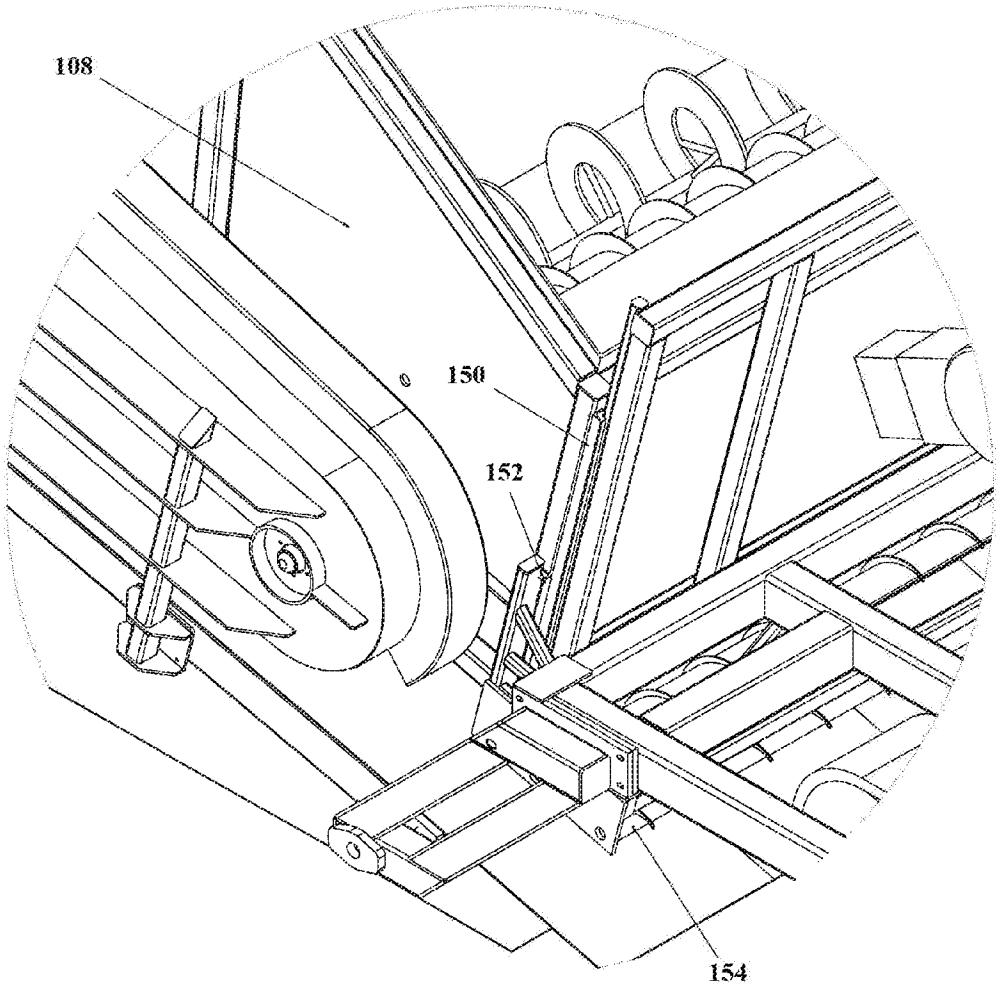
FIG. 12 is a view of a filler distributor for a road surfacing system.

In a preferred embodiment, the connections between the sections discussed above are pinned to give the structure of the machine flexibility allowing an automatic adjustment as the system moves over slopes. To ensure consistent height on the finished road surface the sand distributor 108 height may be adjusted parallel to the face of the rear chassis 134. The method for this is best illustrated in FIG. 12 where a linear track 150 for the distribution system 108 along with a small track 152 for trailing augurs 154 are shown. The distribution system 108 as a whole will preferably move in the longer track 150 to adjust the deposit height while the trailing augurs 154 will adjust independently in the shorter track 152 to level the deposited material at the desired final height. Preferably, this would be automated with sensors detecting a difference in inclination between the two chassis 128, 134 and adjusting the relative height of the sand distributor 108 accordingly. This automation would preferably extend to adjusting the relative speeds of the expanding conveyor and picker conveyors to ensure the pins of each maintain the correct spacing over hills. This spacing is best illustrated in FIG. 13 where it is shown that the sets of pins must be precisely timed to transfer the web from expanding conveyor 102 to the picker conveyor 106.

Figure 10:
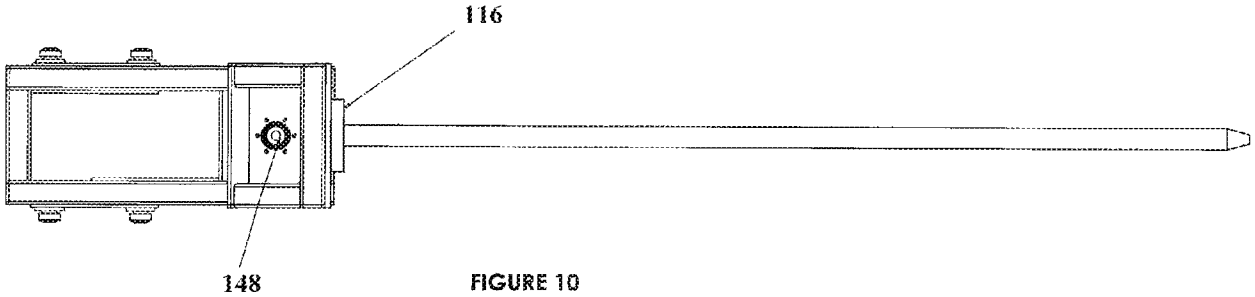
FIG. 10 is a bottom view of a geocloth mount aligned in an operating position.
Figure 11:
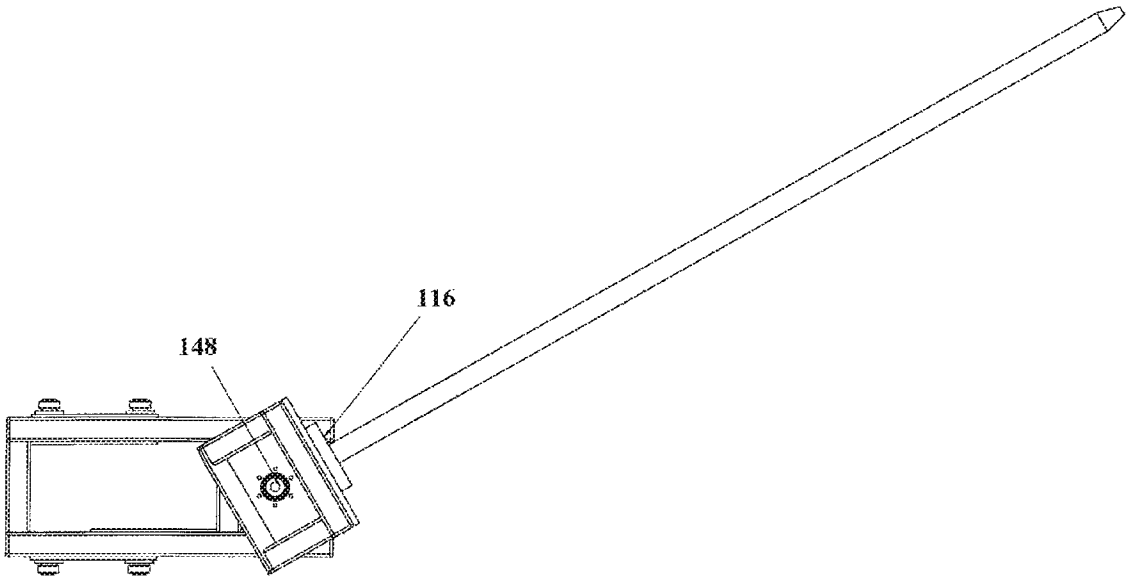
FIG. 11 is a bottom view of the geocloth mount of FIG. 10 where the geocloth mount has been rotated to demonstrate a loading step.

In a preferred embodiment, a layer of geocloth 118 (FIG. 2) will be laid out beneath the webbing as the system progresses. This may be carried out using the mount 116 that allows the geocloth 118 to unspool as the machine progresses using the weight of the filled webbing 122 to pull it out. Preferably, the mount will have the capacity to move on tracks 146 out to the edge of the system while also rotating to minimize the additional width required for installing new rolls. FIG. 2 shows the mounts 116 sitting on the tracks 146 supporting installed geocloth 118. FIG. 10 shows the geocloth mount 116 in the operating position while FIG. 11 shows the geocloth mount 116 rotated about a hub 148.

In embodiments of the road surfacing system, the system creates a stable road surface by filling an expandable web with sand, gravel, or aggregate to create a contained and level road surface. The system may create a stable road surface along which the bulk of its weight can be transported as the road surface is created. This allows operation in wet or marshy conditions.

Although the system described herein is described as a 'road surfacing' system, the term 'road' should be understood in an inclusive sense that extends not just to roadways along which vehicles travel, but also includes other surfaces on which vehicles may be present such as parking lots or industrial work sites. Various configurations of mobile frames may be used to support the road surfacing system. The webbing conveyor may comprise only a single conveyor, two conveyors as shown in FIG. 1 or more than two conveyors. Although the webbing connector is shown mounted on the mobile frame, the webbing connector may be mounted off the frame so that the webbing can be connected, such as by welding, prior to being fed into the conveyor. Various components of the system may be mounted on separate frames, so long as the components can work and move together. For example, the components of the road surfacing system may be mounted on separate but cooperating trailers that move at the same rate. The filler that is distributed with the webbing may be sand, gravel or aggregate or other road surface materials. These and other variations will be apparent to a person skilled in the art.

The invention claimed is:

1. A road surfacing system, comprising:

a mobile frame;

a webbing conveyor mounted on the frame, the webbing conveyor extending between a webbing receiving end and a webbing distributing end, the webbing conveyor comprising a webbing expander between the webbing receiving end and the webbing distributing end; and a filler distributor mounted on the frame adjacent to the webbing distributing end of the webbing conveyor.

2. The road surfacing system of claim 1 further comprising:

a webbing connector mounted on the frame and adjacent to the webbing receiving end of the webbing conveyor.

3. The road surfacing system of claim 2 in which the webbing connector is an automatic welder.

4. The road surfacing system of claim 1 in which the webbing expander further comprises a plurality of pins extending between guides.

5. The road surfacing system of claim 1 in which the webbing conveyor further comprises a plurality of conveyors between the webbing receiving end and the webbing distributing end.

6. The road surfacing system of claim 1 in which the filler distributor further comprises a hopper and an auger.

7. The road surfacing system of claim 1 further comprising a crane mounted on the mobile frame.

8. A road surfacing system, comprising:

a mobile frame;

a webbing conveyor mounted on the frame, the webbing conveyor extending between a webbing receiving end and a webbing distributing end;

a filler distributor mounted on the frame adjacent to the webbing distributing end of the webbing conveyor; and a geocloth dispenser mounted on the frame adjacent to the webbing distributing end of the webbing conveyor.

9. The road surfacing system of claim 1 further comprising a control station mounted on the frame, the control station operatively connected to the webbing conveyor and the filler distributor.

10. The road surfacing system of claim 1 further comprising a vibration plate mounted on the frame adjacent to the webbing distributing end of the webbing conveyor.

11. A road surfacing system, comprising:

a mobile frame;

a webbing conveyor mounted on the frame, the webbing conveyor extending between a webbing receiving end and a webbing distributing end;

a filler distributor mounted on the frame adjacent to the webbing distributing end of the webbing conveyor; and a webbing connector mounted on the frame and adjacent to the webbing receiving end of the webbing conveyor, in which the webbing connector is an automatic welder, and in which the automatic welder further comprises a plurality of welding elements and a first linear actuator operatively connected to the plurality of welding elements, the first linear actuator causing each of the plurality of welding elements to move between an open position and a closed position.

12. The road surfacing system of claim 11 in which the automatic welder further comprises a second linear actuator operatively connected to the plurality of welding elements, the second linear actuator causing each of the plurality of welding elements to move between a raised position and a lowered position.

13. The road surface system of claim 12 in which the automatic welder further comprises a guard plate.

14. A method of surfacing a road, the method comprising:

placing sections of expandable webbing onto a webbing conveyor mounted on a mobile frame, the webbing conveyor extending between a webbing receiving end and a webbing distributing end;

expanding the sections of expandable webbing using a webbing expander between the webbing receiving end and the webbing distributing end of the webbing conveyor;

moving the mobile frame across the ground while the sections of expandable webbing are distributed from a webbing distributing end of the webbing conveyor; and distributing filler with the sections of expandable webbing from a filler distributor mounted on the frame adjacent to the webbing distributing end of the webbing conveyor.

15. The method of claim 14 further comprising connecting adjacent sections of expandable webbing using a webbing connector mounted on the frame adjacent to the webbing receiving end of the webbing conveyor.

16. The method of claim 15 in which the webbing connector is an automatic welder.

17. The method of claim 14 in which the webbing expander further comprises a plurality of pins extending between guides.

18. The method of claim 14 in which the webbing conveyor further comprises a plurality of conveyors between the webbing receiving end and the webbing distributing end.

19. The method of claim 14 in which the filler distributor further comprises a hopper and an auger.

20. A method of surfacing a road, the method comprising:

placing webbing onto a webbing conveyor mounted on a mobile frame, the webbing conveyor extending between a webbing receiving end and a webbing distributing end;

moving the mobile frame across the ground while webbing is distributed from a webbing distributing end of the webbing conveyor;

distributing filler with the webbing from a filler distributor mounted on the frame adjacent to the webbing distributing end of the webbing conveyor; and dispensing geocloth using a geocloth dispenser mounted on the frame adjacent to the webbing distributing end of the webbing conveyor.

21. The method of claim 14 in which a control station is mounted on the frame, the control station operatively connected to the webbing conveyor and the filler distributor.

22. The method of claim 14 further comprising vibrating the filler with the webbing as it is placed on the ground using a vibration plate mounted on the frame adjacent to the webbing distributing end of the webbing conveyor.

23. The road surfacing system of claim 8 in which the webbing conveyor comprises a webbing expander between the webbing receiving end and the webbing distributing end.

24. The road surfacing system of claim 11 in which the webbing conveyor comprises a webbing expander between the webbing receiving end and the webbing distributing end.

* * * * *